US005156257A

United States Patent [19]

Hundebl

[11] Patent Number: 5,156,257

[45] Date of Patent: Oct. 20, 1992

[54] WOODWORKING MACHINE, SUCH AS A TRAVERSING SANDING MACHINE

[75] Inventor: Keld O. Hundebøl, Ansager, Denmark

[73] Assignee: HH Patent A/S, Ansager, Denmark

[21] Appl. No.: 699,179

[22] Filed: May 13, 1991

[30] Foreign Application Priority Data

May 22, 1990 [DK] Denmark ..... 1269/90

[51] Int. Cl.[5] ..... B65G 17/46

[52] U.S. Cl. ..... 198/689.1; 144/242 A; 144/245 A; 51/235

[58] Field of Search ..... 198/493, 494, 689.1, 198/836.2; 144/252 A, 242 A, 245 A; 51/138, 215 E, 235

[56] References Cited

U.S. PATENT DOCUMENTS

| | | | |
|---|---|---|---|
| 2,858,597 | 11/1958 | Kraemer | 51/235 |
| 2,877,607 | 3/1959 | Haracz | 51/235 |
| 3,359,648 | 12/1967 | Overly et al. | 198/689.1 X |
| 3,850,088 | 11/1974 | Tobey et al. | 198/689.1 X |
| 3,872,627 | 3/1975 | Schuster | 51/135 R |
| 3,889,801 | 6/1975 | Boyer | 198/689 |
| 4,003,226 | 1/1977 | Holdsworth | 69/1 |
| 4,323,149 | 4/1982 | Pavone | 198/689.1 |
| 4,416,090 | 11/1983 | Jonasson | 51/138 |
| 4,704,823 | 11/1987 | Steinback | 51/138 X |
| 4,719,721 | 1/1988 | Stump | 198/689.1 X |

FOREIGN PATENT DOCUMENTS

| | | | |
|---|---|---|---|
| 1577361 | 1/1970 | Fed. Rep. of Germany | 51/138 |

*Primary Examiner*—Robert P. Olszewski
*Assistant Examiner*—James R. Bidwell
*Attorney, Agent, or Firm*—Darby & Darby

[57] ABSTRACT

A woodworking machine of the traversing type for carrying items (23) on a vacuum conveyor belt (3) is provided with a number of compressed air nozzles (10) which direct a stream of air towards the items (23) on the belt, the nozzles (10), being connected to the pressure side (9) of air pumps (6), and the suction of the conveyor (3) is connected to the pump's inlet sides (8). A reduction in the friction of the belt (13) as well as the wear on its supporting plate (18), is obtained by the formation of eddy currents in grooves (20), formed in the belt supporting plate (18) through which the air is sucked.

5 Claims, 4 Drawing Sheets

WOODWORKING MACHINE, SUCH AS A TRAVERSING SANDING MACHINE

BACKGROUND OF THE INVENTION

The invention relates to a woodworking machine, such as a wood sanding machine, with a supporting and conveying device for an item during its passage through the machine, and with an endless belt which runs over two reversing rollers and is provided with a rib pattern on its upper surface for the formation of evenly distributed recesses, each of which has an air suction hole connected to the vacuum side of an air pump via channels, so that an item can be secured on the belt by the vacuum in the recesses during passage through the machine.

Machines of this type are used especially within the woodworking industry for various forms of finishing operations such as sanding.

Of such machines can be mentioned those for the sanding and polishing of surfaces in finishing operations, or as a link in a surface-treatment process such as lacquering.

For the feeding of the items during the processing in the machine, it is preferable to use an endless belt which is provided with holes and suction from underneath. This functions as a so-called vacuum conveyor on which the items can be secured.

With items having a limited plane supporting surface, the vacuum retaining power is naturally limited, the reason being that this depends solely on the area and thus the number of suction holes which the item can cover, and herewith the vacuum which exits under the item. In such cases, the retention is reduced, and thus the feed speed must be reduced in order to prevent the item from moving on the belt or possibly being lifted completely from the belt.

In such cases, the item must be secured manually to the belt by means of clamps, rails or the like. This is time-consuming and makes it difficult to effect an automatic working operation.

BRIEF DESCRIPTION OF THE INVENTION

The invention to overcome this disadvantage of the known machines, and this is achieved by further providing the machine with a series of air nozzles above the belt, said nozzles being connected via channels to the pressure side of the air pump so that the item is pressed down against the upper surface of the belt by the air.

The retaining power is hereby considerably increased, and thus items which are normally difficult to retain, either because of a curvature in shape or a relatively small contact surface against the belt, can now be effectively secured without risk of being displaced on the belt. This is due particularly to the extra compression which the air discharge exercises on the items, and which can be established without any reduction in the size of the machining chamber or interference with the machining process.

Furthermore, this nozzle arrangement does not require any particular energy over and above the loss of pressure which arises as a result of flow resistance in the channels and the nozzles. Moreover, the flow of air directed against the items during processing results in the items being continuously blown clean of dust and fibers, whereby it is not only ensured that the process is optimized but also that the belt is kept completely clean during conveyance, and hereby that the function of the recesses is not disturbed.

Finally, this increased flow of air in the working chamber of the machine provides efficient ventilation and cooling, which further contributes towards reducing the wear on machine parts and hereby extends the lifetime of the machine.

By mounting the nozzles both on the front and the rear of the machine, the items are blown totally clean after the processing, which means that they can continue directly into a lacquering plant or the like.

Further, by mounting a supporting surface with longitudinal channels under the belt, the contact pressure of the belt against the plate, and herewith the friction, is reduced to such a degree that not only is the energy required to move the belt reduced, but it also enables the whole construction of the conveyor to be simplified.

Finally, it is possible to allow the sum of the throughflow openings through the belt and the plate to be substantially identical, whereby an effective underpressure can be achieved while at the same time reducing the friction between the parts.

The invention will now be described in more detail with reference to the drawing, where

DETAILED DESCRIPTION OF THE INVENTION

Figure 1:
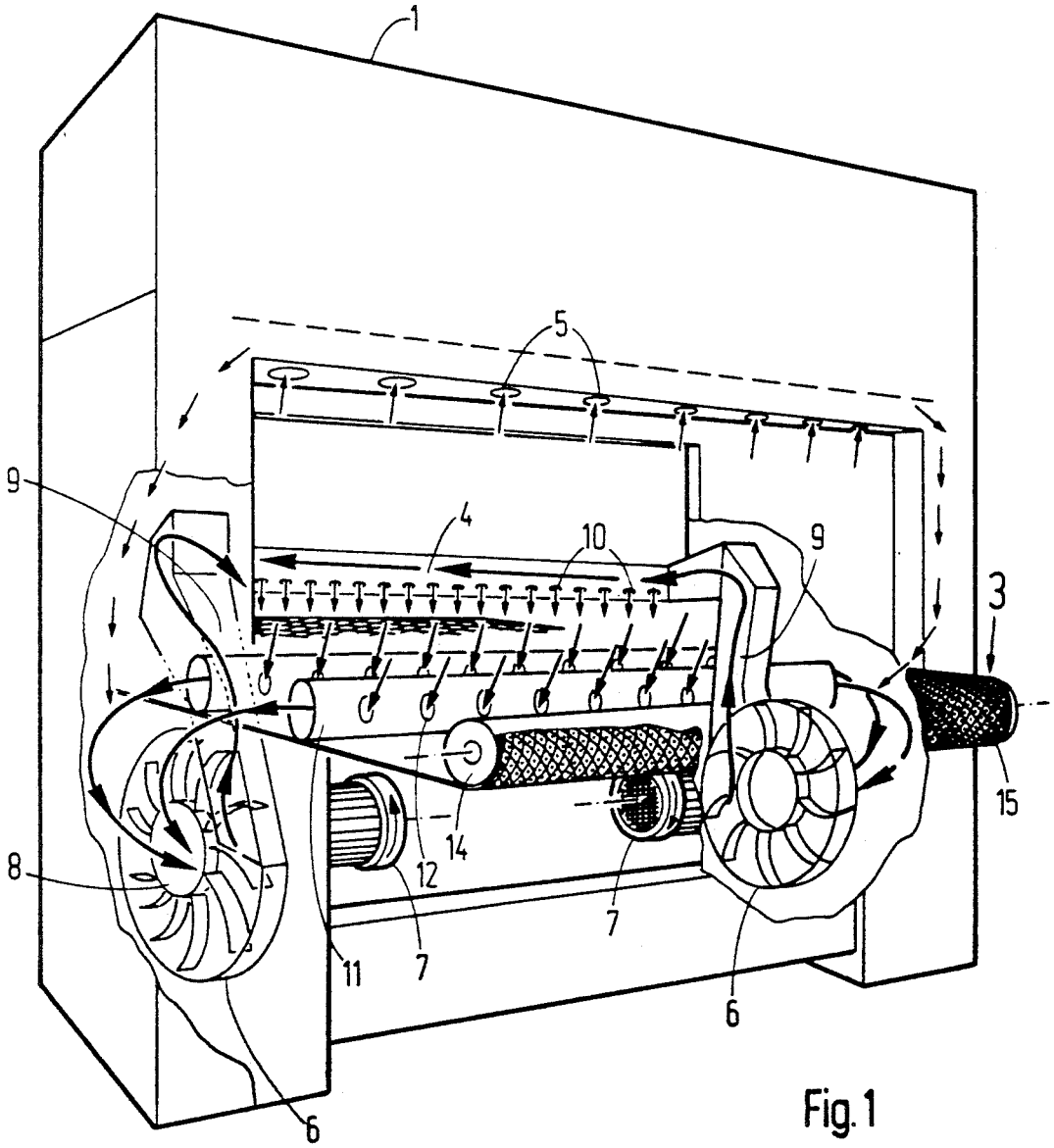
FIG. 1 shows a perspective illustration of a machine partly in section.
Figure 2:
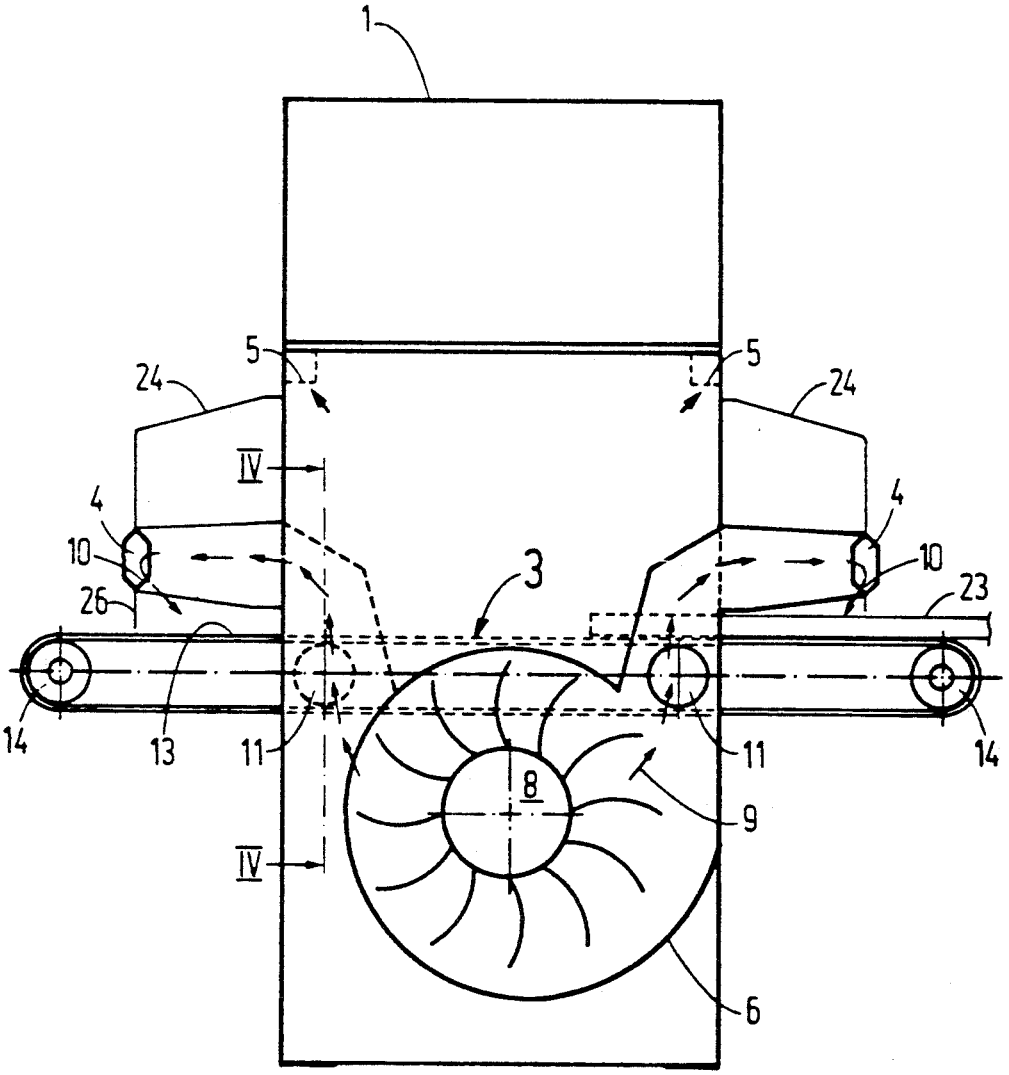
FIG. 2 shows a machine seen in section from the side.
Figure 3:
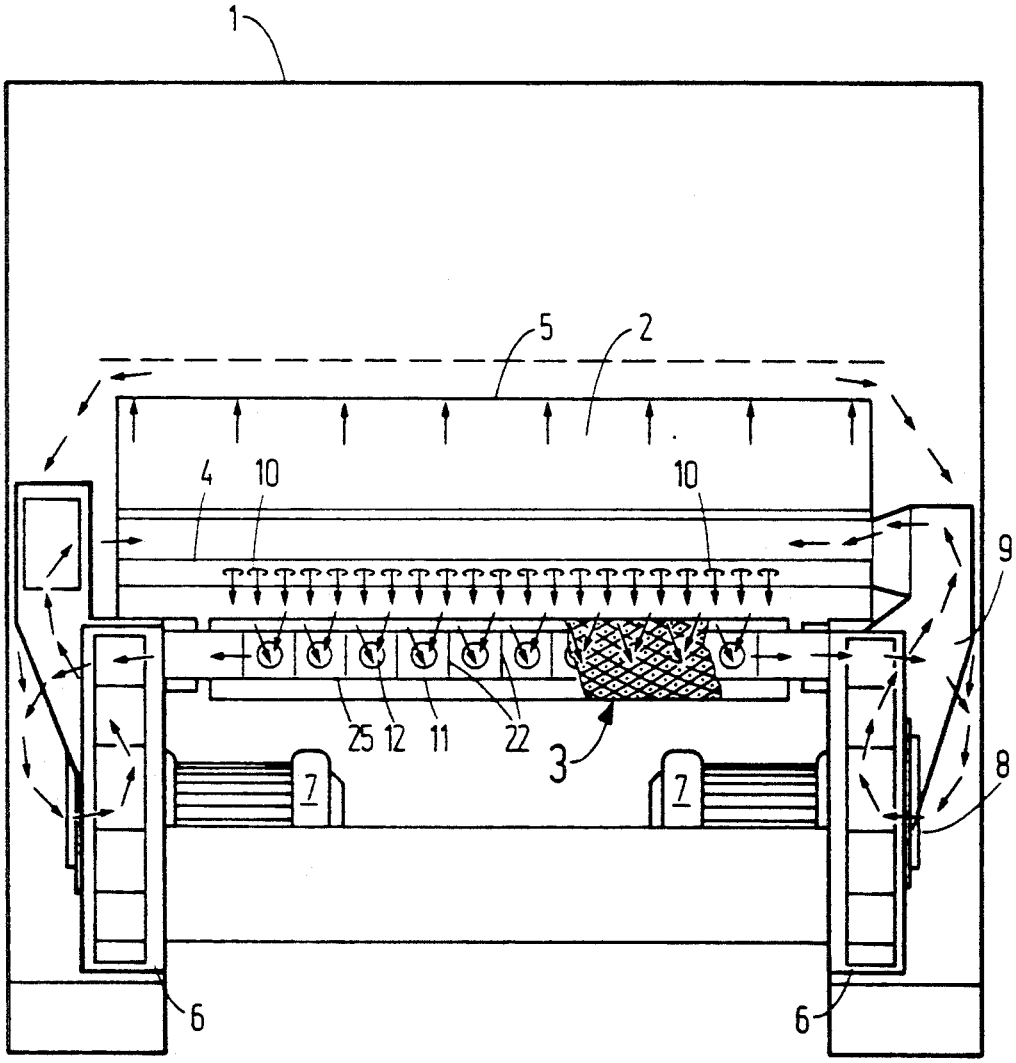
FIG. 3 shows the machine seen in section from the end.

In FIGS. 1-3 is shown an example of a preferred embodiment of a machine comprising a cabinet 1 consisting of an underframe on which the movable plane 3 is mounted, plus side portions on which rests an upper part.

Between the upper part and the plane 3 there exits a processing chamber 2 in which there is mounted a machining tool (not-shown), so that an item 23 placed on the belt 3 can be processed by the tool in a commonly-known manner during its passage through the machine.

As will appear from FIGS. 1 and 3, in the cabinet 1 there is an air pump 6 in the form of a radial pump mounted in each side. The pump is driven by a motor 7 and is placed in such a way that the air intake 8 and air outlet 9 of the pump 6 face outwards towards the side parts.

These side parts have a built-in system of air channels, i.e. a pressure channel system connected to the pressure sides 9 of the pumps 6 and a vacuum channel system connected to their suction sides 8, whereby an almost closed air system is created in the machine, which therefore functions in the most economic manner.

The pressure channels open out in two series of nozzles 10 which extend above the belt 3 in a transverse channel 4, which as indicated in FIG. 2 can be housed in a front shield 24 which below the nozzles is further provided with a skirt 26 through which the items 23 can be introduced and fed out on the conveyor 3.

The nozzles 10 are oriented in such a manner that the air currents are directed downwards towards the items 23 on the conveyor 3, whereby the items are pressed down against and hereby secured on the belt.

In the upper part of the machine there is also seen a commonly-known exhaustion system comprising a suction head 5 which, via a commonly-known dust filter, is connected to a suction system which can possibly form part of the closed air system.

As shown in FIG. 2, the conveyor 3 is built up of an endless rubber belt 13 which runs over two reversing rollers 14 mounted at the ends of the conveyor 3, and which are coupled to a drive arrangement so that the belt 13 can run around the rollers 14.

The speed at which the belt 13 moves can be variable for adjustment of the feed during operation.

Figure 4:
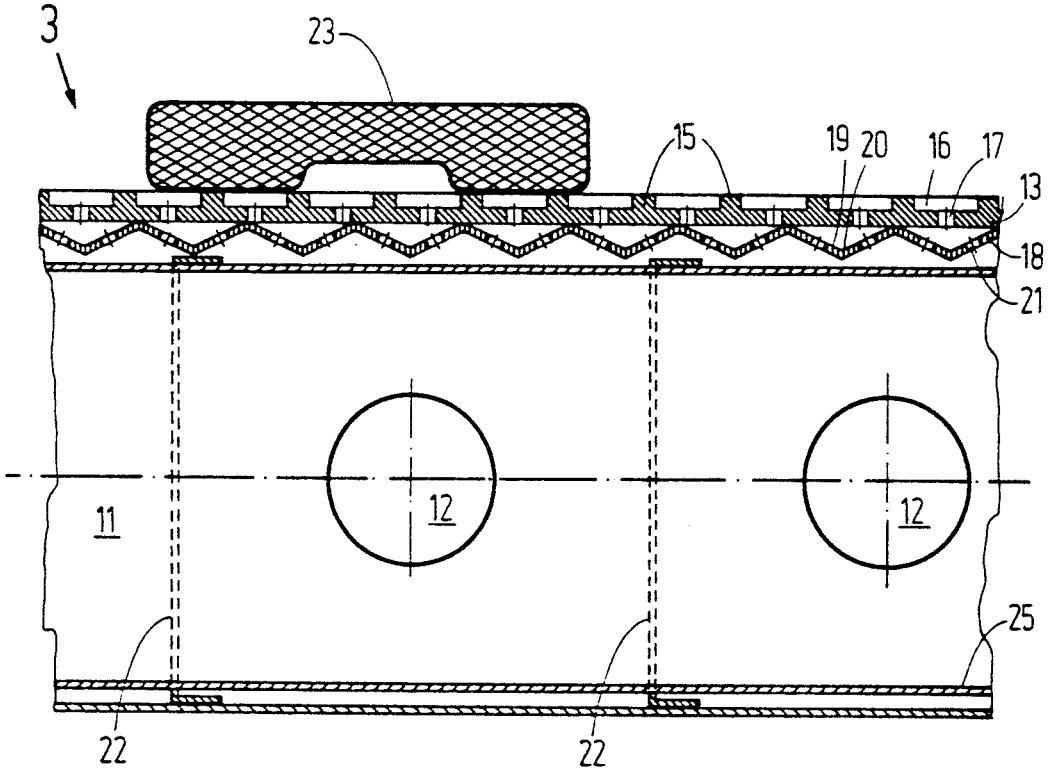
FIG. 4 shows a section of the actual conveyor belt seen in the direction IV—IV in FIG. 2.

The construction of the conveyor 3 itself is shown in FIG. 4. The rubber belt 13 has a plane underside and an upperside patterned with upwardly-extending ribs 15 which with the same height form a pattern of recesses 16. In each of these recesses 16 there is a hole 17 through the belt 13, thus giving rise to a surface consisting of low pressure chambers as indicated in FIGS. 1 and 3.

The belt 13 is supported underneath by a metal plate 18 which extends at the same level between the reversing rollers 14, so that the belt 13 is supported by the plate 18 during its passage through the machine.

The plate 18 is also configured with a number of grooves which extend lengthwise with the direction of movement of the belt, and which have a breadth which corresponds substantially to the largest breadth of the recesses 16. The belt 13 is thus supported only by the raised portions between the recesses 16, as shown in FIG. 4. In the wall 19 of the recesses there are also holes 21 for the passage of air through the plate 18.

Mounted under the plate 18 there are a number of separating walls 22 which extend down in the plane to a baseplate 25, thus forming a chamber of the desired length under the belt 13.

Finally, two pipes or channels 11, see FIGS. 1 and 2, are mounted transversely to the conveyor 3 and between the separating walls 22, said pipes 11 being connected to the low-pressure channel system in the machine which is connected to the inlet channels 8 of the air pumps 6.

The mode of operation of the air system will now be described.

Upon start-up of the machine, the drive motor for the reversing rollers 14 is activated, whereby the belt 13 is driven around. The air pumps 6 are also started, whereby compressed air is fed through the nozzles 10 over the belt. At the same time, air is sucked out through the recesses 16 via the holes 17 in the belt 13, through the holes 21 in the plate 18, through the openings 12 in the longitudinal channels 11, and also through the suction nozzles 5 in the processing chamber 2.

Hereafter, the not-shown processing tool can be started and the machine is ready for operation.

An item 23 placed on the belt 13, see FIGS. 3 and 4, will now be secured on said belt, in that the item will shut off the supply of air from outside to some of the recesses 16, and will also be pressed downwards by the downwardly-directed stream of air from the nozzles 10.

At the same time that the item 23 is thus better secured than with the hitherto-known vacuum conveyors, said item will be blown clean while being fed into as well as out of the machine. The suction system inside the processing chamber 2 ensures that the dust-laden air is constantly exhausted and cleaned during operations before it is again fed back to the channel system.

The suction at the recesses 16 is effected further via the groove-formed channels 20, where it should be noted that the air creates eddies in these grooves, so that the air is reflected towards among other things the underside of the belt 13. The belt 13 is hereby lifted or eased slightly away from the plate 18, whereby the friction is quite considerably reduced. This reduces not only the power required for driving the belt, but also the wear on the belt and the plate. Moreover, this also results in a very smooth and uniform conveyor movement, and thus a feeding of the item which ensures the best possible processing result.

I claim:

1. A woodworking machine comprising:

an endless driven belt for conveying articles through the machine from an inlet part to an outlet part, said belt having;

a rib pattern on its upper surface defining recesses between the ribs, the articles resting on said ribs;

openings in at least some of said recesses for providing suction;

air pump means having a suction side and a pressure side;

first means providing communication between said pump means suction side and the holes of said belt to provide a suction force to said belt grooves as a first force to hold the articles on the belt during conveyance, at least one nozzle means located above said belt and the articles thereon to direct air onto said articles; and second means providing communication between the pressure side of said pump means and said nozzle means to supply air to said nozzle means which is directed onto said articles to apply a second force to hold the articles to the belt.

2. A woodworking machine as in claim 1 further comprising:

a support plate for said belt on which the belt slides; said belt formed with longitudinal grooves in the direction of belt travel and having openings therein communicating with said second means for the suction air to pass to and through the belt.

3. A woodworking machine as in claim 2 wherein the area of the openings in the belt is substantially the same as the area of the openings in the plate.

4. A woodworking machine as in claim 1 wherein said nozzle means is located at each of the inlet and outlet parts of the machine.

5. A woodworking machine as in claim 2 wherein said nozzle means is located at each of the inlet and outlet parts of the machine.

* * * * *